US011841640B2

(12) United States Patent
Itoh

(10) Patent No.: US 11,841,640 B2
(45) Date of Patent: Dec. 12, 2023

(54) IMAGE FORMING APPARATUS COMPRISING DEVELOPMENT SWITCHING UNIT AND CURRENT DETECTION UNIT

(71) Applicant: CANON KABUSHIKI KAISHA, Tokyo (JP)

(72) Inventor: Masatoshi Itoh, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/052,465

(22) Filed: Nov. 3, 2022

(65) Prior Publication Data

US 2023/0144792 A1 May 11, 2023

(30) Foreign Application Priority Data

Nov. 9, 2021 (JP) ..... 2021-182334

(51) Int. Cl.
*G03G 15/00* (2006.01)
*G03G 21/16* (2006.01)
*G03G 15/08* (2006.01)

(52) U.S. Cl.
CPC ..... *G03G 15/0865* (2013.01); *G03G 15/80* (2013.01); *G03G 21/1647* (2013.01); *G03G 21/1676* (2013.01); *G03G 2221/1654* (2013.01); *G03G 2221/1657* (2013.01)

(58) Field of Classification Search
CPC ..... G03G 15/0865; G03G 15/0884; G03G 15/0886; G03G 21/1647; G03G 21/1676; G03G 2221/1654; G03G 2221/1657
See application file for complete search history.

(56) References Cited

U.S. PATENT DOCUMENTS

2020/0033788 A1* 1/2020 Ohashi ..... G03G 21/1676
2020/0338916 A1* 10/2020 Itoh ..... B41J 29/38
2021/0223713 A1* 7/2021 Ikegami ..... G03G 21/1676
2021/0278798 A1* 9/2021 Ikegami ..... G03G 21/1676
2021/0325821 A1* 10/2021 Ikegami

FOREIGN PATENT DOCUMENTS

JP 2006292868 A 10/2006
JP 2010079282 A 4/2010

* cited by examiner

*Primary Examiner* — Sophia S Chen
(74) *Attorney, Agent, or Firm* — Canon U.S.A., Inc. I.P. Division

(57) ABSTRACT

An image forming apparatus includes a photosensitive member, a developing roller, first and second motors, a drive-train having a drive switching unit, and a development switching unit. The drive-train transmits a driving force of the first motor to the developing roller. The second motor drives the drive switching unit and the development switching. The drive switching unit switches between a driving force transmission state and a driving force non-transmission state. The development switching unit switches between a developing roller-photosensitive member contact state and a developing roller-photosensitive member separated state, and operates with an operation of the drive switching unit. When the drive switching unit transitions from the non-transmission to the transmission state and a detected magnitude of a current flowing through the first motor has changed, the second motor is stopped before the developing roller is brought into contact with the photosensitive member while driving the first motor.

8 Claims, 10 Drawing Sheets

IMAGE FORMING APPARATUS COMPRISING DEVELOPMENT SWITCHING UNIT AND CURRENT DETECTION UNIT

BACKGROUND

Field

The present disclosure relates to an image forming apparatus using an electrophotographic method, such as a printer, a copying machine, and a facsimile machine.

Description of the Related Art

Some available image forming apparatuses have a configuration in which a developing roller is movable between a position at which the developing roller is brought into contact with a photosensitive member and a position at which the developing roller is separate from the photosensitive member. An image forming apparatus discussed in Japanese Patent Application Laid-Open No. 2006-292868 includes a separation cam that separates a developing roller from a photosensitive member, and a developing clutch that switches rotating and stationary states of the developing roller. The separation cam and the developing clutch are synchronized with each other and operated by a stepping motor. In the image forming apparatus discussed in Japanese Patent Application Laid-Open No. 2006-292868, the developing roller is brought into contact with the photosensitive member after the rotation of the developing roller is started.

There are available image forming apparatuses in which the developing roller is brought into contact with the photosensitive member, it is desirable that the developing roller is fully coated with toner. Accordingly, it is desirable to bring the developing roller into contact with the photosensitive member after the developing roller is fully rotated.

In some available image forming apparatuses, if the stepping motor is stopped after the developing roller is rotated and before the developing roller is brought into contact with the photosensitive member, the developing roller is rotated before the developing roller is brought into the photosensitive member, enabling the developing roller to be coated with toner. However, a period from a time when driving of the stepping motor is started to a time when rotation of the developing roller is started and a period from a time when driving of the stepping motor is started to a time when the developing roller is brought into contact with the photosensitive member vary depending on the tolerance of parts and the like. This may make it difficult to reliably stop the stepping motor at a timing after the developing roller is rotated and before the developing roller is brought into contact with the photosensitive member.

SUMMARY

The present disclosure is directed to providing an image forming apparatus configured to bring a developing roller into contact with a photosensitive member after the developing roller is fully rotated in a configuration in which the developing roller is movable between a position at which the developing roller is brought into contact with the photosensitive member and a position at which the developing roller is separate from the photosensitive member.

One aspect of the present disclosure is as follows.

According to an aspect of the present disclosure, an image forming apparatus includes a photosensitive member, a developing roller, a first motor configured to drive the developing roller, a drive-train configured to transmit a driving force of the first motor to the developing roller and including a drive switching unit, wherein the drive switching unit is configured to switch between a transmission state where the driving force is transmitted to the developing roller and a non-transmission state where the driving force is not transmitted to the developing roller, a development switching unit configured to switch between a contact state where the developing roller is brought into contact with the photosensitive member and a separated state where the developing roller is separate from the photosensitive member, and configured to operate in conjunction with an operation of the drive switching unit, a second motor configured to drive the development switching unit and the drive switching unit, a control unit configured to control the first motor and the second motor, and a current detection unit configured to detect a current flowing through the first motor, wherein, in a case where the drive switching unit transitions from the non-transmission state to the transmission state and a magnitude of the current detected by the current detection unit has changed, the control unit is configured to execute a stop operation to stop the second motor before the developing roller is brought into contact with the photosensitive member while driving the first motor.

Further features of the present disclosure will become apparent from the following description of exemplary embodiments with reference to the attached drawings.

DESCRIPTION OF THE EMBODIMENTS

Exemplary embodiments of the present disclosure will be illustratively described in detail below with reference to the accompanying drawings. The dimensions, materials, shapes, relative arrangements, and the like of components described in the following exemplary embodiments should be appropriately changed depending on the configuration of an apparatus to which the present disclosure is applied and various conditions. Therefore, the scope of the present disclosure is not limited only to the exemplary embodiments unless otherwise specified.

(Image Forming Apparatus)

Figure 1:
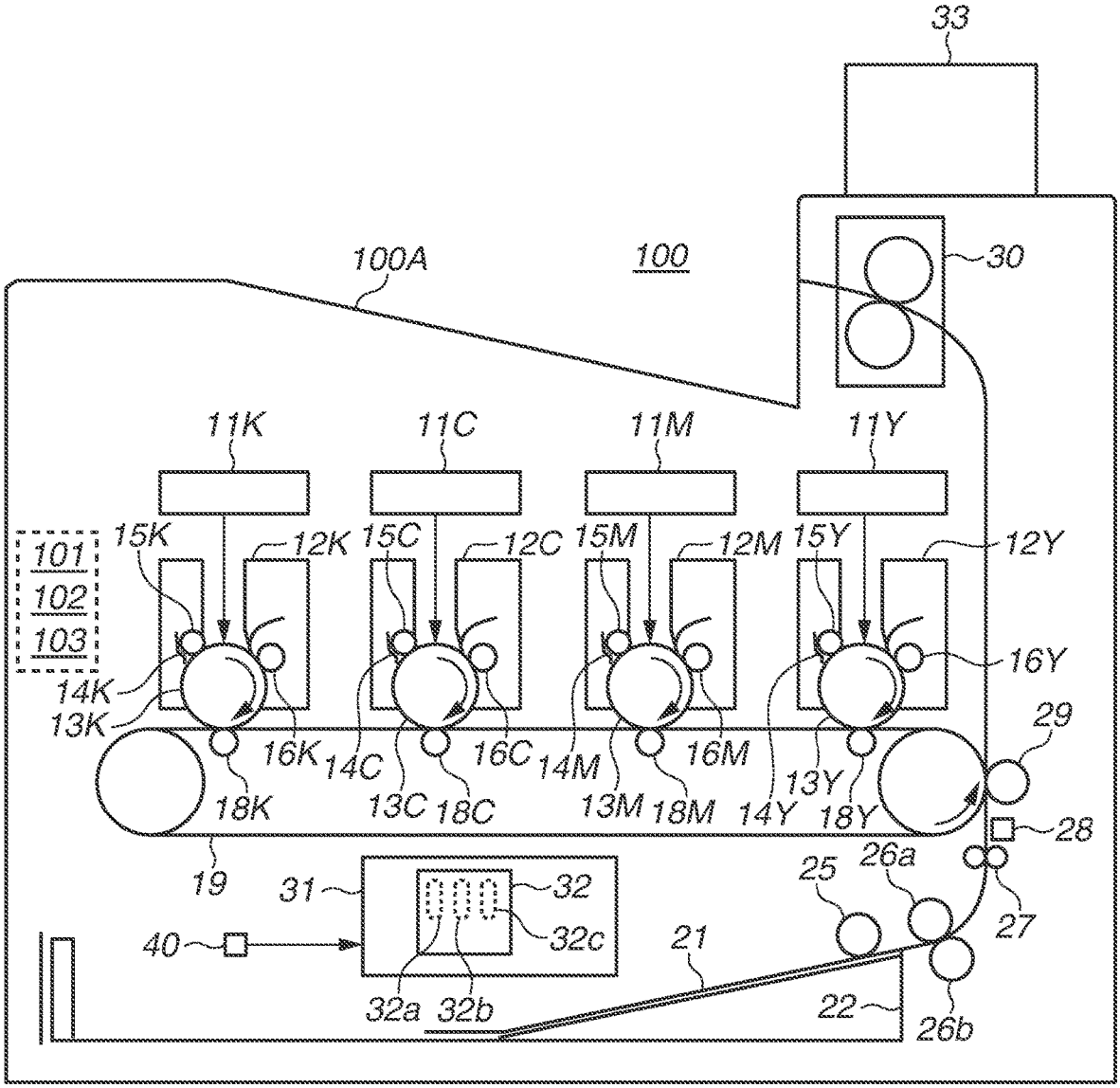
FIG. 1 is a schematic sectional view of an image forming apparatus.

A first exemplary embodiment of the present disclosure will be described. An image forming apparatus 100 according to the present exemplary embodiment will be described with reference to FIG. 1. FIG. 1 is a schematic sectional view of the image forming apparatus 100. The image forming apparatus 100 according to the present exemplary embodiment is a tandem color laser printer using an electrophotographic process. A configuration example of the image forming apparatus 100 will be described with reference to FIG. 1.

The image forming apparatus 100 is configured to output a full-color image by forming toner images of four colors, yellow (Y), magenta (M), cyan (C), and black (K), in a superimposed manner. The image forming apparatus 100 includes laser scanners (11Y, 11M, 11C, 11K) each serving as an exposure device and cartridges (12Y, 12M, 12C, 12K) to form images of the respective colors. The cartridges (12Y, 12M, 12C, 12K) are each configured to be detachably attached to an apparatus body 100A of the image forming apparatus 100.

The cartridges (12Y, 12M, 12C, 12K) include photosensitive members (13Y, 13M, 13C, 13K) and photosensitive member cleaners (14Y, 14M, 14C, 14K), respectively. The photosensitive members (13Y, 13M, 13C, 13K) are each configured to rotate in a direction indicated by an arrow in FIG. 1. The photosensitive member cleaners (14Y, 14M, 14C, 14K) are each provided to be in contact with the corresponding photosensitive member. The cartridges (12Y, 12M, 12C, 12K) further include charging rollers (15Y, 15M, 15C, 15K) and developing rollers (16Y, 16M, 16C, 16K), respectively.

The photosensitive members (13Y, 13M, 13C, 13K) are photosensitive drums each serving as an image carrying member configured to carry an electrostatic latent image. The photosensitive member cleaners (14Y, 14M, 14C, 14K) are cleaning members that are brought into contact with the photosensitive members (13Y, 13M, 13C, 13K), respectively, and are configured to remove toner serving as developer from the surfaces of the photosensitive members (13Y, 13M, 13C, 13K), respectively. The charging rollers (15Y, 15M, 15C, 15K) are charging members that charge the surfaces of the photosensitive members (13Y, 13M, 13C, 13K), respectively. The developing rollers (16Y, 16M, 16C, 16K) are developer carrying members (developing members) that carry toner and develop the electrostatic latent image formed on the surfaces of the photosensitive members (13Y, 13M, 13C, 13K).

The image forming apparatus 100 further includes an intermediate transfer belt 19 that is in contact with the photosensitive members (13Y, 13M, 13C, 13K), and primary transfer rollers (18Y, 18M, 18C, 18K). The intermediate transfer belt 19 is located such that a part of the intermediate transfer belt 19 is sandwiched between the primary transfer rollers (18Y, 18M, 18C, 18K) and the photosensitive members (13Y, 13M, 13C, 13K).

The image forming apparatus 100 further includes an A-motor 101, a B-motor 102, and a C-motor 103.

In the present exemplary embodiment, the A-motor 101 rotates the developing rollers (16Y, 16M, 16C, 16K), the B-motor 102 rotates the photosensitive members (13Y, 13M, 13C), and the C-motor 103 rotates the intermediate transfer belt 19 and the photosensitive member 13K. The A-motor 101, the B-motor 102, and the C-motor 103 are direct-current (DC) brushless motors. Which member each of the A-motor 101, the B-motor 102, and the C-motor 103 rotates is not limited to this configuration.

The image forming apparatus 100 further includes a cassette 22 that stores sheets 21 serving as recording materials. Paper, a resin film, and the like are used as the sheets 21. A feed roller 25, a conveyance roller 26*a*, a separation roller 26*b*, and registration rollers 27 are provided downstream of the cassette 22 in a conveyance direction of the sheets 21. A conveyance sensor 28 is provided downstream of the registration rollers 27 in the conveyance direction of the sheets 21, and a secondary transfer roller 29 is provided downstream of the conveyance sensor 28 so that the secondary transfer roller 29 is in contact with the intermediate transfer belt 19. A fixing device 30 is provided downstream of the secondary transfer roller 29.

A controller (printer control unit) 31 is a control unit of the image forming apparatus 100. The controller 31 includes a central processing unit (CPU) 32 including a read-only memory (ROM) 32*a*, a random access memory (RAM) 32*b*, and a timer 32*c*, and one or more various input/output control circuits (not illustrated). A display panel 33 displays an image based on a signal from the CPU 32 of the controller 31. The image displayed on the display panel 33 includes characters and graphics. The display panel 33 displays information relating to usage of the image forming apparatus 100 and information relating to the state of the image forming apparatus 100, including the state of the cartridges (12Y, 12M, 12C, 12K).

Next, an image forming operation for forming an image on each sheet 21 will be briefly described. In dark places in the cartridges (12Y, 12M, 12C, 12K), the surfaces of the photosensitive members (13Y, 13M, 13C, 13K) are uniformly charged by the charging rollers (15Y, 15M, 15C, 15K), respectively. A driving force of the B-motor 102 is drive-transmitted by a drive transmission unit including a gear, thus rotating the photosensitive members (13Y, 13M, 13C). Similarly, a driving force of the C-motor 103 is drive-transmitted by a drive transmission unit including a gear, thus rotating the photosensitive member 13K and the intermediate transfer belt 19.

Next, the laser scanners (11Y, 11M, 11C, 11K) irradiate the surfaces of the photosensitive members (13Y, 13M, 13C, 13K) with a laser beam based on image data. Electric charge in a portion irradiated with the laser beam is removed to thereby form the electrostatic latent image on the surfaces of the photosensitive members (13Y, 13M, 13C, 13K).

A developing bias is applied to the developing rollers (16Y, 16M, 16C, 16K) carrying toner, so that toner adheres to the electrostatic latent image formed on the surfaces of the photosensitive members (13Y, 13M, 13C, 13K) from the developing rollers (16Y, 16M, 16C, 16K). Adherence of toner to the surfaces of the photosensitive members (13Y, 13M, 13C, 13K) based on the electrostatic latent image forms toner images of the respective colors on the surfaces of the photosensitive members (13Y, 13M, 13C, 13K).

A primary transfer bias is applied to the primary transfer rollers (18Y, 18M, 18C, 18K). Thus, the toner images formed on the surfaces of the photosensitive members (13Y, 13M, 13C, 13K) are attracted onto the intermediate transfer belt 19 at a nip portion (primary transfer portion) formed by the photosensitive members (13Y, 13M, 13C, 13K) and the intermediate transfer belt 19.

The CPU 32 controls an image forming timing for each of the cartridges (12Y, 12M, 12C, 12K) depending on the moving speed of the intermediate transfer belt 19. The toner image is transferred onto the surface of the intermediate transfer belt 19 from each of the cartridges (12Y, 12M, 12C, 12K), so that a full-color image is finally formed on the surface of the intermediate transfer belt 19.

By contrast, the sheets 21 stored in the cassette 22 are conveyed by the feed roller 25. The sheets 21 are separated one by one by the conveyance roller 26*a* and the separation roller 26*b* and the separated sheet 21 is conveyed toward the registration rollers 27. The sheet 21 passes through the registration rollers 27 and is conveyed toward the secondary transfer roller 29. The toner image formed on the surface of the intermediate transfer belt 19 is transferred onto the sheet 21 at a nip portion (secondary transfer portion) formed by the secondary transfer roller 29 and the intermediate transfer belt 19. The fixing device 30 performs a heat fixing process on the toner image transferred onto the sheet 21. The sheet 21 onto which the toner image is fixed is discharged to the outside of the image forming apparatus 100.

In the present exemplary embodiment, the image forming apparatus 100 includes an environmental temperature sensor 40 for measuring the environmental temperature of outside air, and is capable of performing the image forming operation depending on the measured environmental temperature. For example, the magnitude of the developing bias or primary transfer bias can be changed depending on the external environmental temperature.

<Configuration for Driving A-Motor>

Figure 2:
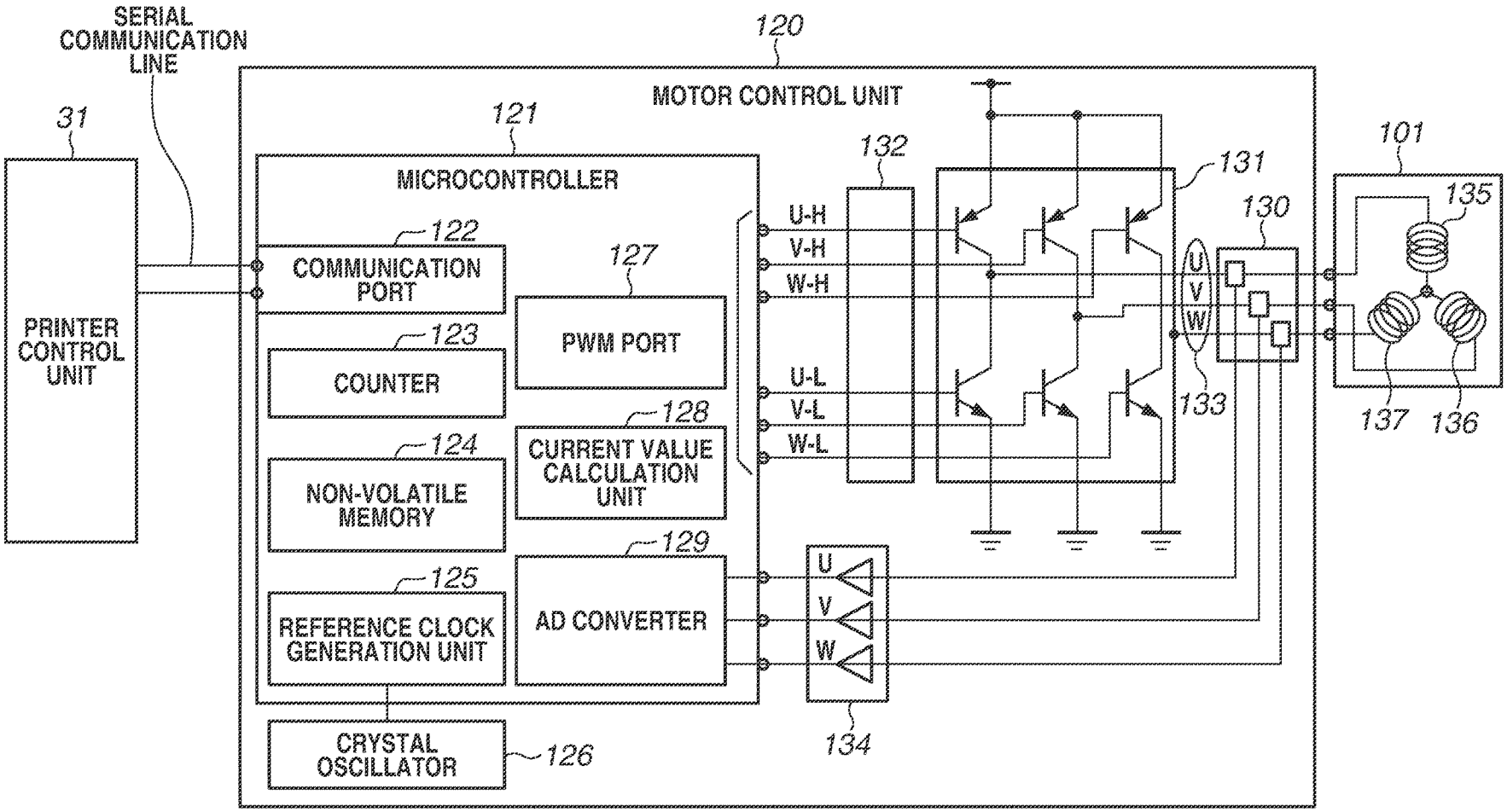
FIG. 2 is a block diagram illustrating a configuration of a motor control unit.

Next, a configuration for driving the A-motor 101 will be described with reference to FIG. 2. FIG. 2 is a block diagram illustrating a configuration of a motor control unit 120.

In the present exemplary embodiment, the A-motor 101 is a brushless motor that is controlled using vector control. The motor control unit 120 is a circuit for rotating the A-motor 101. The CPU 32 of the controller 31 controls the A-motor 101 via the motor control unit 120. The motor control unit 120 includes an arithmetic processing unit using, for example, a microcontroller 121. The microcontroller 121 includes therein a communication port 122, an analog-to-digital (AD) converter 129, a counter 123, a non-volatile memory 124, a reference clock generation unit 125, a crystal oscillator 126, a pulse-width modulation (PWM) port 127, and a current calculation unit 128. The counter 123 performs a counting operation based on a reference clock generated by the reference clock generation unit 125. For example, measurement of an input pulse cycle and generation of PWM signals are performed based on the counting operation.

The PWM port 127 includes six terminals and outputs PWM signals, including three high-level signals (U-H, V-H, W-H) and three low-level signals (U-L, V-L, W-L). The motor control unit 120 includes a three-phase inverter 131 including three high-level switching elements and three low-level switching elements. For example, transistors and field-effect transistors (FETs) can be used as the switching elements.

Each switching element is connected to the PWM port 127 through a gate driver 132, and ON/OFF of each switching element is controllable with the PWM signal output from the PWM port 127. Each switching element is turned on with the PWM signal at a high level (H) and is turned off with the PWM signal at a low level (L).

U-phase, V-phase, and W-phase outputs 133 of the inverter 131 are respectively connected to coils 135, 136, and 137 of the A-motor 101, thus controlling coil currents to be passed through the coils 135, 136, and 137.

A coil current having flowed through each of coils 135, 136, and 137 of the A-motor 101 is detected by a current detection unit. The current detection unit includes a current sensor 130, an amplifier unit 134, the AD converter 129, and the current value calculation unit 128. Initially, a current flowing through each of the coils 135, 136, and 137 is converted into a voltage by the current sensor 130. The amplifier unit 134 amplifies the voltage and applies an offset voltage. The voltage is then input to the AD converter 129 of the microcontroller 121.

For example, assuming that the current sensor 130 outputs a voltage of 0.01 V per 1 A, an amplification factor in the amplifier unit 134 is 10, and an offset voltage to be applied is 1.6 V, an output voltage of the amplifier unit 134 when a current of −10 A to +10 A flows is 0.6 to 2.6 V. The AD converter 129 outputs, for example, a voltage of 0 to 3 V as an AD value of 0 to 4095. Thus, the AD value when a current of −10 A to +10 A flows is approximately 819 to 3549. As for the polarity of a current, it is assumed that the current is positive in a case where the current flows from the three-phase inverter 131 to the A-motor 101.

The current value calculation unit 128 performs predetermined arithmetic processing on AD-converted data (hereinafter referred to as an AD value), to calculate a current value. More specifically, an offset value is subtracted from the AD value and the resultant is multiplied by a predetermined coefficient, thus obtaining the current value. The offset value corresponds to the AD value of the offset voltage of 1.6 V and is approximately 2184. The coefficient is approximately 0.00733. In the present exemplary embodiment, the AD value that is loaded when no coil current is passed therethrough, and is stored is used as the offset value. The coefficient is preliminarily stored as a normal coefficient in the non-volatile memory 124.

The microcontroller 121 controls the three-phase inverter 131 through the gate driver 132 thus passing a current through each of the coils 135, 136, and 137 of the A-motor 101. The microcontroller 121 causes the current sensor 130, the amplifier unit 134, and the AD converter 129 to detect the current flowing through the coils 135, 136, and 137, and calculates the rotor position and speed of the A-motor 101 based on the detected current. These configurations enable the microcontroller 121 to control the rotation of the A-motor 101.

Figure 3:
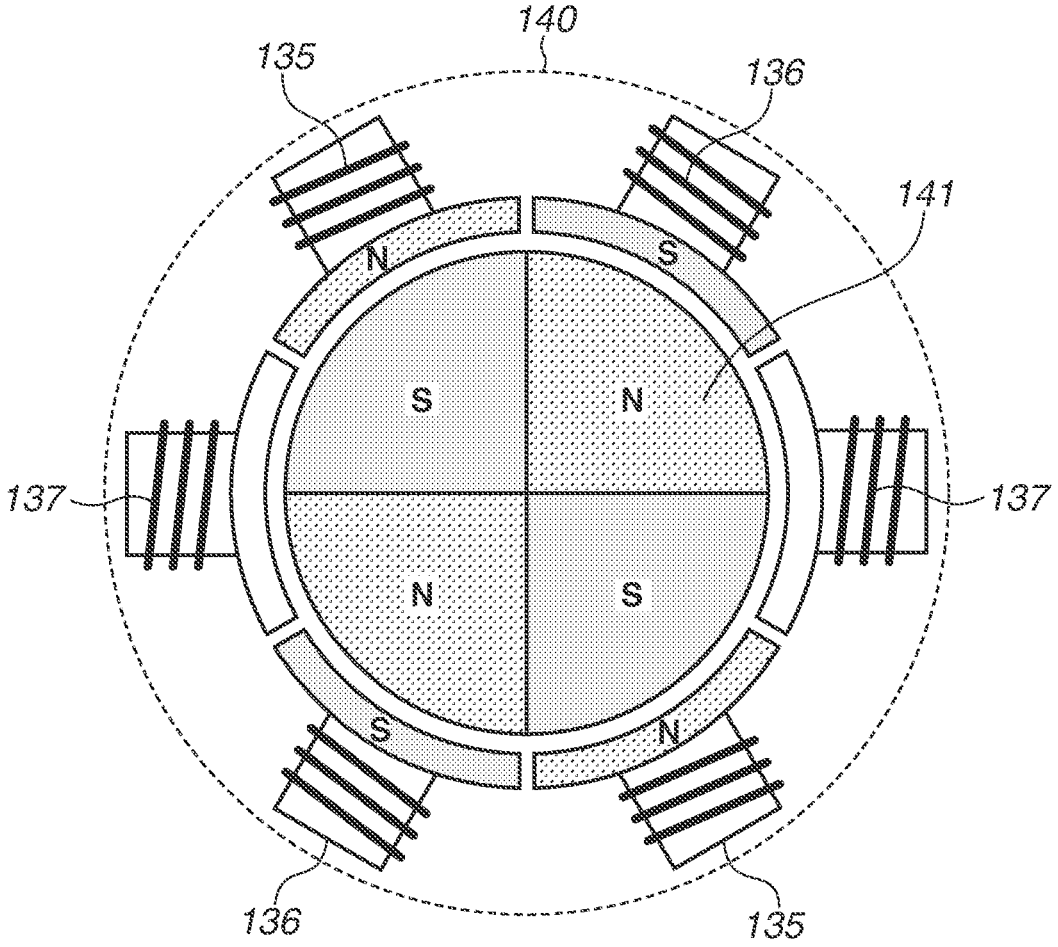
FIG. 3 is an explanatory diagram illustrating a structure of an A-motor.

Next, the structure of the A-motor 101 will be described with reference to FIG. 3. FIG. 3 is an explanatory diagram illustrating the structure of the A-motor 101.

The A-motor 101 includes a 6-slot stator 140 and a 4-pole rotor 141. The stator 140 includes the coils 135, 136, and 137 of U-phase, V-phase, and W-phase, respectively. The rotor 141 is formed of a permanent magnet and includes two pairs of N pole and S pole. The coils 135, 136, and 137 of U-layer, V-layer, and W-layer are connected to the respective outputs 133 of the inverter 131.

<Configuration for Driving and Moving Developing Rollers>

Figure 4:
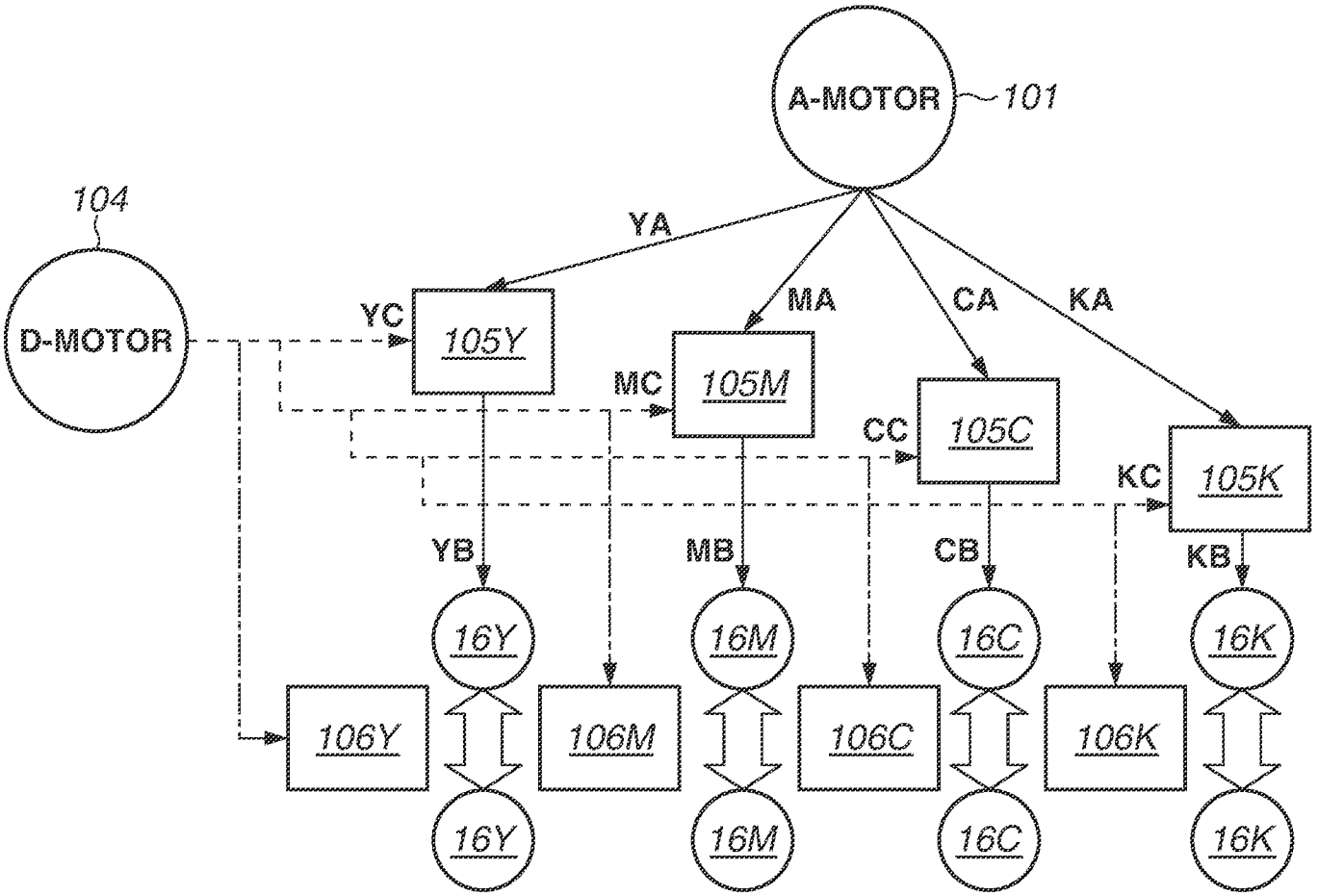
FIG. 4 illustrates driving and movement of a developing roller.

Next, a configuration for driving the developing rollers (16Y, 16M, 16C, 16K) to rotate and a mechanism for moving the developing rollers (16Y, 16M, 16C, 16K) relative to the photosensitive members (13Y, 13M, 13C, 13K) will be described with reference to FIG. 4. FIG. 4 illustrates driving and movement of the developing rollers (16Y, 16M, 16C, 16K).

The image forming apparatus 100 includes the A-motor (first motor) 101 configured to drive the developing rollers (16Y, 16M, 16C, 16K) and a drive-train for transmitting the driving force of the A-motor 101 to the developing rollers (16Y, 16M, 16C, 16K).

More specifically, the image forming apparatus 100 includes, as the drive-train, drive transmission units (YA, YB, MA, MB, CA, CB, KA, and KB) and mechanical clutches (105Y, 105M, 105C, 105K). The drive transmission units YA, MA, CA, and KA can be referred to as upstream drive transmission units. The drive transmission units YB, MB, CB, and KB can be referred to as downstream drive transmission unit. Each of the mechanical clutches (105Y, 105M, 105C, 105K) is located between the corresponding one of the upstream drive transmission units (YA, MA, CA, and KA) and the corresponding one of the downstream drive transmission units (YB, MB, CB, and KB). The upstream drive transmission units (YA, MA, CA, and KA) and the downstream drive transmission units (YB, MB, CB, and KB) are a gear-train including at least one gear. The cartridges (12Y, 12M, 12C, 12K) may include a part of the drive-train.

The image forming apparatus 100 further includes developing movement mechanisms (106Y, 106M, 106C, 106K) and a D-motor (second motor) 104. The D-motor 104 is configured to drive the developing movement mechanisms (106Y, 106M, 106C, 106K) and the mechanical clutches (105Y, 105M, 105C, 105K). In the present exemplary embodiment, the D-motor 104 is configured to control the rotation position (e.g., a stepping motor).

The mechanical clutches (105Y, 105M, 105C, 105K) each serve as a drive switching unit configured to switch between a transmission state where the driving force of the A-motor 101 is transmitted to the developing rollers (16Y, 16M, 16C, 16K) and a non-transmission state where the driving force is not transmitted. The mechanical clutches (105Y, 105M, 105C, 105K) are driven by the D-motor 104 to thereby switch the transmission state and the non-transmission state of the mechanical clutches (105Y, 105M, 105C, 105K).

The developing movement mechanisms (106Y, 106M, 106C, 106K) each serve as a development switching unit (development contact/separation mechanism) configured to switch the positional relationship between the photosensitive members (13Y, 13M, 13C, 13K) and the developing rollers (16Y, 16M, 16C, 16K) between a contact position and a separated position. A state where the photosensitive members (13Y, 13M, 13C, 13K) and the developing rollers (16Y, 16M, 16C, 16K) are brought into contact with each other is referred to as a contact state. A state where the developing rollers (16Y, 16M, 16C, 16K) are separate from the photosensitive members (13Y, 13M, 13C, 13K) is referred to as a separated state. The developing movement mechanisms (106Y, 106M, 106C, 106K) can be configured to switch the state of the photosensitive members (13Y, 13M, 13C, 13K) and the developing rollers (16Y, 16M, 16C, 16K) between the contact state and the separated state.

In the present exemplary embodiment, the developing movement mechanisms (106Y, 106M, 106C, 106K) are configured to press a part of the cartridges (12Y, 12M, 12C, 12K). Thus, the developing rollers (16Y, 16M, 16C, 16K) move relative to the photosensitive members (13Y, 13M, 13C, 13K). A cam that presses a part of the cartridges (12Y, 12M, 12C, 12K) can be used as the developing movement mechanisms (106Y, 106M, 106C, 106K).

The developing movement mechanisms (106Y, 106M, 106C, 106K) and the mechanical clutches (105Y, 105M, 105C, 105K) are coupled with switch transmission units (YC, MC, CC, KC), respectively. In the present exemplary embodiment, the switch transmission units (YC, MC, CC, KC) are a gear-train including at least one gear. Thus, in a case where the mechanical clutches (105Y, 105M, 105C, 105K) are operated, the developing movement mechanisms (106Y, 106M, 106C, 106K) are also operated. More specifically, the developing movement mechanisms (106Y, 106M, 106C, 106K) are operated after a lapse of a predetermined period from a time when the mechanical clutches (105Y, 105M, 105C, 105K) are operated.

In the case of performing the image forming operation, in response to the D-motor 104 being driven, the mechanical clutches (105Y, 105M, 105C, 105K) are sequentially switched from the non-transmission state to the transmission state and the driving force of the A-motor 101 is transmitted to the developing rollers (16Y, 16M, 16C, 16K).

The developing movement mechanisms (106Y, 106M, 106C, 106K) are sequentially operated in conjunction with the operation of the mechanical clutches (105Y, 105M, 105C, 105K), respectively. The developing movement mechanisms (106Y, 106M, 106C, 106K) sequentially switch the state of the developing rollers (16Y, 16M, 16C, 16K) with respect to the photosensitive members (13Y, 13M, 13C, 13K) from the separated state to the contact state.

In this case, the developing movement mechanism 106Y operates in such a manner that the developing roller 16Y is brought into contact with the photosensitive member 13Y after the mechanical clutch 105Y shifts from the non-transmission state to the transmission state. The developing movement mechanisms (106M, 106C, 106K) and the mechanical clutches (105M, 105C, 105K) also operate similarly.

After completion of the image forming operation, the D-motor 104 is driven to sequentially operate the developing movement mechanisms (106Y, 106M, 106C, 106K). The developing movement mechanisms (106Y, 106M, 106C, 106K) sequentially switch the state of the developing rollers (16Y, 16M, 16C, 16K) with respect to the photosensitive members (13Y, 13M, 13C, 13K) from the contact state to the separated state. The mechanical clutches (105Y, 105M, 105C, 105K) are sequentially operated in conjunction with the operation of the developing movement mechanisms (106Y, 106M, 106C, 106K). After that, the state of the mechanical clutches (105Y, 105M, 105C, 105K) is sequentially switched from the transmission state to the non-transmission state, thus blocking the transmission of the driving force of the A-motor 101 to the developing rollers (16Y, 16M, 16C, 16K). As a result, the developing rollers (16Y, 16M, 16C, 16K) are sequentially stopped.

<Timing of Driving and Moving Developing Rollers>

Each timing of driving the developing rollers (16Y, 16M, 16C, 16K) and moving the developing rollers (16Y, 16M, 16C, 16K) relative to the photosensitive members (13Y, 13M, 13C, 13K) will be described with reference to FIG. 5.

Figure 5:
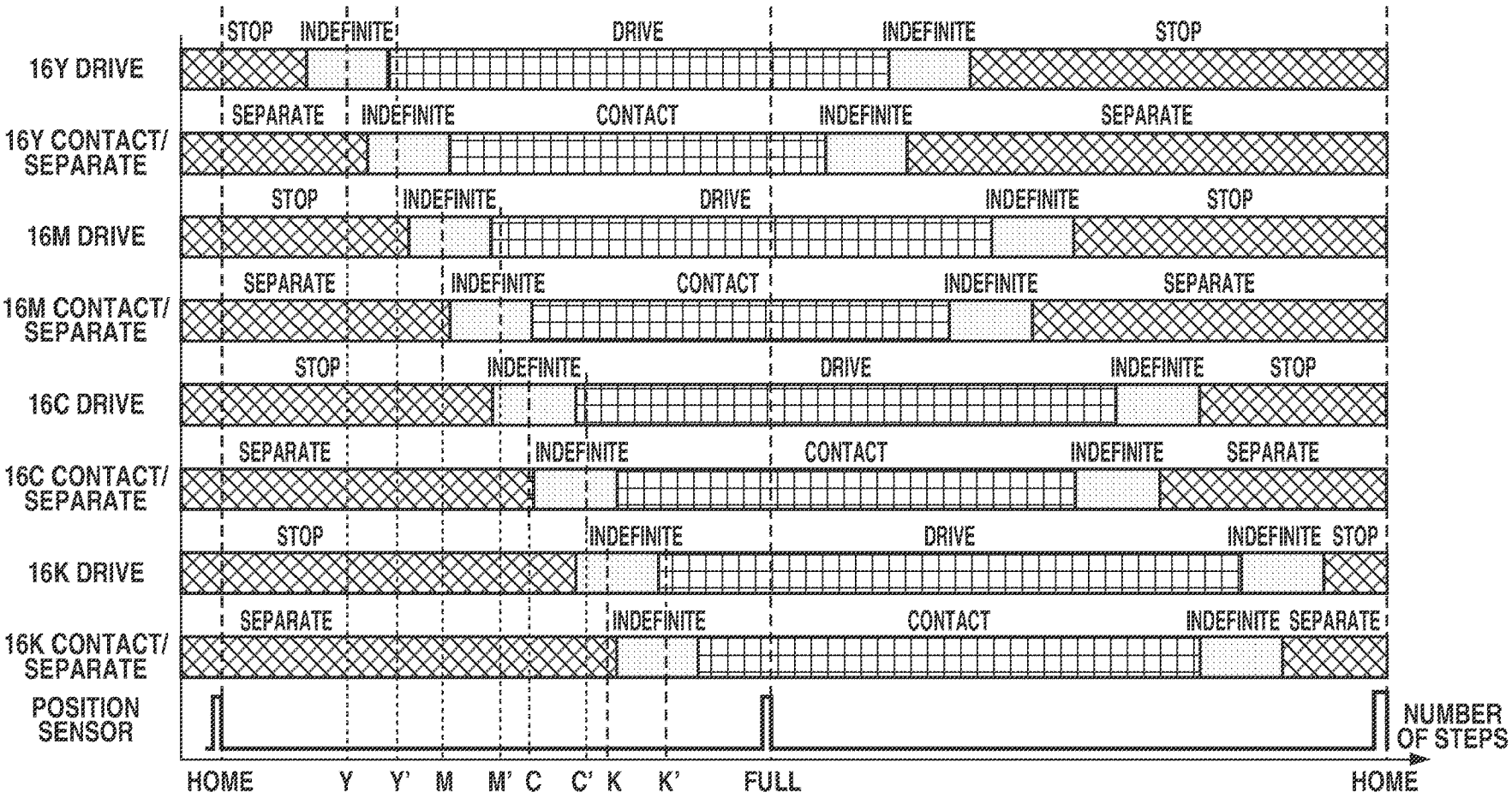
FIG. 5 illustrates each timing of driving the developing roller and moving the developing roller with respect to a photosensitive member.

FIG. 5 is an explanatory diagram illustrating each timing of driving the developing rollers (16Y, 16M, 16C, 16K) and moving the developing rollers (16Y, 16M, 16C, 16K) relative to the photosensitive members (13Y, 13M, 13C, 13K). In FIG. 5, the horizontal axis represents the number of steps of the D-motor 104. FIG. 5 illustrates each timing of driving and stopping the developing rollers (16Y, 16M, 16C, 16K) and each timing of bringing the developing rollers (16Y, 16M, 16C, 16K) into contact with the photosensitive members (13Y, 13M, 13C, 13K) and separating the developing rollers (16Y, 16M, 16C, 16K) from the photosensitive members (13Y, 13M, 13C, 13K).

As described above, driving and stopping of the developing rollers (16Y, 16M, 16C, 16K) are controlled by the mechanical clutches (105Y, 105M, 105C, 105K). Bringing the developing rollers (16Y, 16M, 16C, 16K) into contact with the photosensitive members (13Y, 13M, 13C, 13K) and separating the developing rollers (16Y, 16M, 16C, 16K)

from the photosensitive members (13Y, 13M, 13C, 13K) are controlled by the developing movement mechanisms (106Y, 106M, 106C, 106K).

A position sensor is connected to the D-motor 104 to detect a home position (HOME) for switching between driving and stopping of the developing rollers (16Y, 16M, 16C, 16K) and switching between contacting and separating of the developing rollers (16Y, 16M, 16C, 16K) with respect to the photosensitive members (13Y, 13M, 13C, 13K).

The controller 31 uses the CPU 32 to control the D-motor 104 with a timing when a signal from the position sensor is detected set to the home position. More specifically, the controller 31 operates the D-motor 104 by a predetermined number of steps from the timing when the signal from the position sensor is detected, thus switching between driving and stopping of the developing rollers (16Y, 16M, 16C, 16K) and between contacting and separating of the developing rollers (16Y, 16M, 16C, 16K) with respect to the photosensitive members (13Y, 13M, 13C, 13K).

For example, during the image forming operation, as illustrated in FIG. 5, the D-motor 104 is operated until the number of steps reaches FULL and the developing rollers (16Y, 16M, 16C, 16K) are driven and brought into contact with the photosensitive members (13Y, 13M, 13C, 13K), respectively.

In this case, along with the rotation of the D-motor 104, driving of the developing roller 16Y, contacting of the developing roller 16Y, driving of the developing roller 16M, contacting of the developing roller 16M, driving of the developing roller 16C, contacting of the developing roller 16C, driving of the developing roller 16K, and contacting of the developing roller 16K are performed. Then, the number of steps of the D-motor 104 reaches FULL. The developing movement mechanisms (106Y, 106M, 106C, 106K) and the mechanical clutches (105Y, 105M, 105C, 105K) are coupled with the switch transmission units (YC, MC, CC, KC), respectively. Accordingly, when the D-motor 104 is rotated in one direction, the sequence of operations described above is not changed.

After completion of the image forming operation, the D-motor 104 is operated until the number of steps reaches HOME from FULL, and the developing rollers (16Y, 16M, 16C, 16K) are stopped and separated from the photosensitive members (13Y, 13M, 13C, 13K), respectively.

In this case, along with the rotation of the D-motor 104, separating of the developing roller 16Y, stopping of the developing roller 16Y, separating of the developing roller 16M, stopping of the developing roller 16M, separating of the developing roller 16C, stopping of the developing roller 16C, separating of the developing roller 16K, and stopping of the developing roller 16K are performed. Then, the number of steps of the D-motor 104 reaches HOME.

The image forming operation is performed in conjunction with the above-described operations, thus reducing the time for rotating the developing rollers (16Y, 16M, 16C, 16K) and the time to bringing the developing rollers (16Y, 16M, 16C, 16K) into contact with the photosensitive members (13Y, 13M, 13C, 13K), while reducing First Print Out Time (FPOT).

As a result, degradation of toner and parts such as the developing rollers (16Y, 16M, 16C, 16K) can be suppressed.

A timing when driving and stopping of the developing rollers (16Y, 16M, 16C, 16K) are actually switched may vary depending on the number of steps of the D-motor 104 due to the tolerance of various parts of the image forming apparatus 100 and the like. Similarly, a timing when the developing rollers (16Y, 16M, 16C, 16K) are actually brought into contact with and separated from the photosensitive members (13Y, 13M, 13C, 13K) may also vary. A region where a desired operation can be performed in some cases and cannot be performed in other cases on the operation of the D-motor 104 depending on the degree of variations in timing as described is hereinafter referred to as an indefinite region.

For example, as illustrated in FIG. 5, if stopping and driving of the developing roller 16Y are switched at the earliest, the timing thereof corresponds to the left end of the indefinite region, and if stopping and driving of the developing roller 16Y are switched at the slowest, the timing thereof corresponds to the right end of the indefinite region. Similarly, if separating and contacting of the developing roller 16 are switched at the earliest, the timing thereof corresponds to the left end of the indefinite region, and if separating and contacting of the developing roller 16 are switched at the slowest, the timing thereof corresponds to the right end of the indefinite region. Here, in order to prevent the timing when stopping and driving of the developing roller 16Y are switched and the timing when separating and contacting of the developing roller 16Y are switched from being replaced with each other, the developing movement mechanism 106Y and the mechanical clutch 105Y are coupled with the switch transmission unit YC. For example, the developing roller 16Y is brought into contact with the photosensitive member 13Y after the developing roller 16Y is driven, and the developing roller 16Y is then stopped after being separated from the photosensitive member 13Y. The image forming apparatus 100 is configured to prevent the developing roller 16M from being driven earlier than the developing roller 16Y. This relationship also holds true for the other developing rollers 16M, 16C, and 16K.

<Cartridges>

The cartridges (12Y, 12M, 12C, 12K) according to the present exemplary embodiment will be described in more detail below.

In the present exemplary embodiment, stations for forming images of the respective colors include the cartridges (12Y, 12M, 12C, 12K) and members that operate on the cartridges (12Y, 12M, 12C, 12K). These stations have the same configuration, except for the colors of toner stored in the cartridges (12Y, 12M, 12C, 12K). Accordingly, if there is no need to distinguish the stations from each other, symbols (Y, M, C, K) denoting the respective colors of stored toner are omitted.

Figure 10:
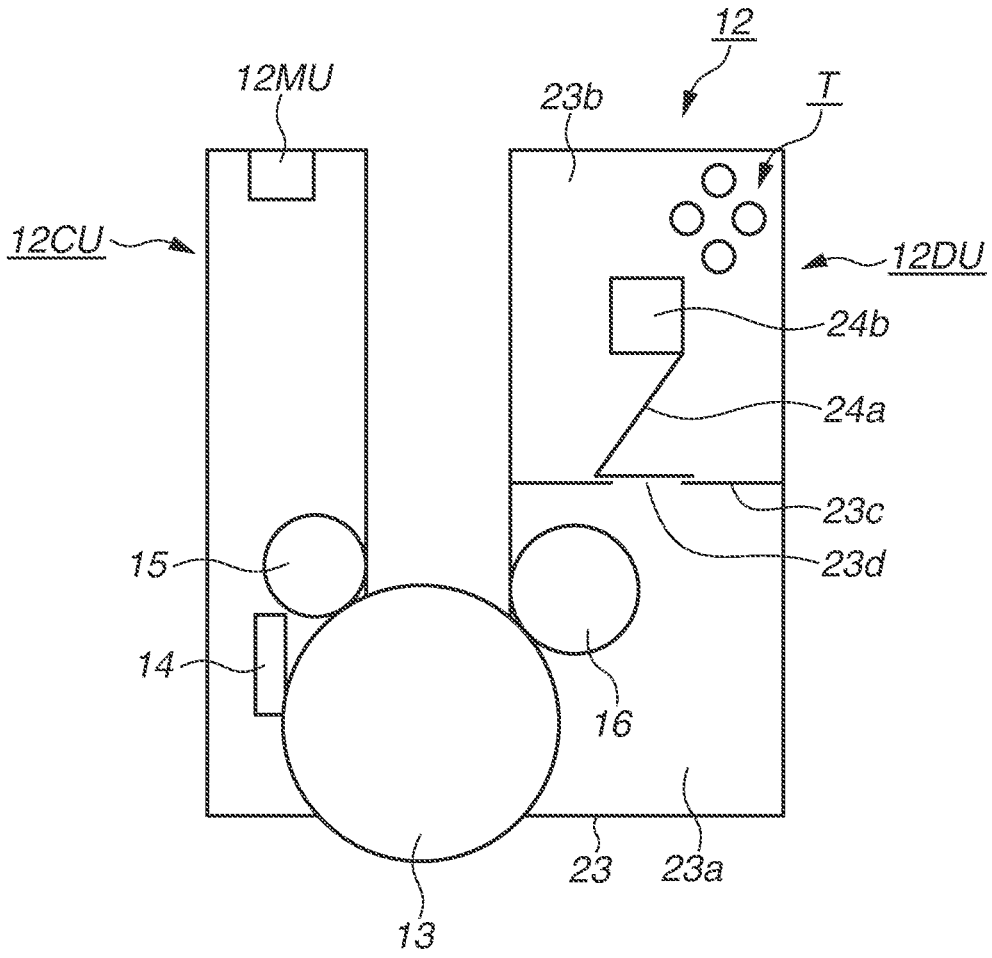
FIG. 10 is a schematic view of a cartridge.

FIG. 10 is a schematic view of the cartridge 12 according to the present exemplary embodiment. The cartridge 12 includes a drum unit 12CU including the photosensitive member 13 and the charging roller 15, and a developing unit 12DU including the developing roller 16. In the present exemplary embodiment, the developing unit 12DU is movable relative to the drum unit 12CU. In response to the developing unit 12DU being moved relative to the drum unit 12CU, the developing roller 16 is moved to the contact position at which the developing roller 16 is brought into contact with the photosensitive member 13 and the separated position at which the developing roller 16 is separate from the photosensitive member 13. In the present exemplary embodiment, the developing unit 12DU is pressed by the developing movement mechanism 106, thus moving the developing unit 12DU relative to the drum unit 12CU.

The developing unit 12DU includes a developing frame 23 serving as a storage portion. The developing frame 23 includes a toner chamber 23*b* that stores toner T, a developing chamber 23*a* that is provided with the developing roller 16, and a partition wall 23*c* that partitions the toner chamber 23*b* from the developing chamber 23*a*. The partition wall 23*c* has an opening 23*d* through which the toner chamber 23*b* communicates with the developing chamber 23*a*. The toner T stored in the toner chamber 23*b* is supplied to the developing roller 16 through the opening 23*d*.

The developing unit 12DU includes a seal member 24*a* that covers the opening 23*d*, and an unsealing member 24*b* that moves the seal member 24*a*. The seal member 24*a* is attached to the partition wall 23*c* of the developing frame 23 so as to cover the opening 23*d* in a state where the cartridge 12 is not used yet (state where the cartridge 12 is new). Thus, the toner T is prevented from moving from the toner chamber 23*b* to the developing chamber 23*a*. In the present exemplary embodiment, the unsealing member 24*b* is rotatably supported by the developing frame 23 and is stored in the toner chamber 23*b*. When the unsealing member 24*b* is rotated, the seal member 24*a* is wound around the unsealing member 24*b*. As a result, the seal member 24*a* retracts from a position at which the opening 23*d* is covered, so that the opening 23*d* is exposed.

A position at which the opening 23*d* is covered with the seal member 24*a* can be referred to as a sealed position, and a position at which the opening 23*c* is exposed can be referred to as an unsealed position. In other words, the seal member 24*a* is moved from the sealed position to the unsealed position by the unsealing member 24*b* driven by the A-motor 101.

In the present exemplary embodiment, when the new cartridge 12 is attached to the inside of the image forming apparatus 100, the controller 31 starts a seal removal sequence to move the seal member 24*a* to the sealed position from the unsealed position. More specifically, the controller 31 is configured to cause the CPU 32 to control the A-motor 101 and the D-motor 104, and drives the A-motor 101 and the D-motor 104 to apply the driving force of the A-motor 101 to the developing unit 12DU. The driving force of the A-motor 101 applied to the developing unit 12DU drives the developing roller 16 and the unsealing member 24*b*, thus moving the seal member 24*a* from the sealed position to the unsealed position.

When the seal member 24*a* is located at the unsealed position, the toner T stored in the toner chamber 23*b* is supplied to the developing roller 16 through the opening 23*d*.

The controller 31 determines whether the cartridge 12 is a new cartridge based on information stored in, for example, a memory 12MU of the cartridge 12.

In the present exemplary embodiment, when the cartridge 12 is replaced with a new one, the drum unit 12CU and the developing unit 12DU are replaced at the same time. In another embodiment, the developing unit 12DU and the drum unit 12CU may be separately detachably attached to the apparatus body 100A. In such a case, in a case where the developing unit 12DU is detached from the apparatus body 100A and is replaced with a new one, the seal removal sequence is executed. The developing unit 12DU may include a memory corresponding to the memory 12MU.

<Contact Between Developing Roller and Photosensitive Member>

When the developing roller 16 is brought into contact with the photosensitive member 13, it is desirable that the developing roller 16 is fully coated with toner. For example, external additive for toner is uniformly supplied to the photosensitive member cleaner 14 in a rotational axis direction of the photosensitive member 13, enabling the photosensitive member cleaner 14 to stably clean the surface of the photosensitive member 13. In such a case, if the developing roller 16 is not fully coated with toner, the external additive cannot be uniformly supplied to the photosensitive member cleaner 14. This phenomenon is more likely to occur when the cartridge 12 is a new cartridge, or when the developing unit 12DU is a new developing unit.

Accordingly, it is desirable to bring the developing roller 16 into contact with the photosensitive member 13 after the developing roller 16 is rotated for a certain period of time. During a period in which the seal removal sequence is executed, the toner T stored in the toner chamber 23*b* cannot be sufficiently supplied to the developing roller 16, which may lead to a state where the developing roller 16 cannot be fully coated with toner. Therefore, it is desirable to perform the seal removal sequence in a state where the developing roller 16 is separate from the photosensitive member 13.

Here, the D-motor 104 is stoppable by any number of steps. If the D-motor 104 is stopped after the developing roller 16 is rotated and before the developing roller 16 is brought into contact with the photosensitive member 13, the developing roller 16 can be rotated in a state where the developing roller 16 is separate from the photosensitive member 13.

Here, a period from a time when the image forming operation is started to a time when image formation on the first sheet 21 is completed is referred to as a first printing period. To shorten the first printing period and prevent the wear of the developing roller 16, it is desirable to shorten the period from the time when the developing roller 16 starts rotation to the time when the developing roller 16 is brought into contact with the photosensitive member 13.

However, if the period from the time when the developing roller 16 starts rotation to the time when the developing roller 16 is brought into contact with the photosensitive member 13 is short as in the image forming apparatus 100 according to the present exemplary embodiment, it is difficult to preliminarily determine the timing of stopping the D-motor 104. On the other hand, if the period from the time when the developing roller 16 starts rotation to the time when the developing roller 16 is brought into contact with the photosensitive member 13 is long, a first printing period increases and the number of rotations of the developing roller 16 also increases.

As illustrated in FIG. 5, in a case where the D-motor 104 is stopped by the number of steps represented by Y, M, C, and K, the D-motor 104 is stopped before the developing rollers (16Y, 16M, 16C, 16K) are brought into contact with the photosensitive members (13Y, 13M, 13C, 13K), respectively. However, the number of steps represented by Y, M, C, and K each overlap the respective indefinite region associated with switching between stopping and driving of the developing rollers (16Y, 16M, 16C, 16K). Accordingly, in the image forming apparatus 100 in which driving of the developing rollers (16Y, 16M, 16C, 16K) is started late, the developing rollers (16Y, 16M, 16C, 16K) are in the stopped state.

Similarly, as illustrated in FIG. 5, in a case where the D-motor 104 is stopped by the number of steps represented by Y', M', C', and K', the D-motor 104 is stopped after driving of the developing rollers (16Y, 16M, 16C, 16K) is started. However, the number of steps represented by Y', M', C', and K' overlap the indefinite region associated with switching between separating and contacting of the developing rollers (16Y, 16M, 16C, 16K). Thus, in the image forming apparatus 100 in which the developing rollers (16Y, 16M, 16C, 16K) are brought into contact early, the developing rollers (16Y, 16M, 16C, 16K) are in contact with photosensitive members (13Y, 13M, 13C, 13K), respectively.

As described above, in the method of stopping the D-motor 104 by the predetermined number of steps, it is difficult to reliably achieve the rotation of the developing roller 16 in a state where the developing roller 16 is separate from the photosensitive member 13.

<Detection of Driving of Developing Roller>

A method for rotating the developing roller 16 in a state where the developing roller 16 is separate from the photosensitive member 13 will be described with reference to FIG. 6.

As described above, for the image forming apparatus 100 according to the present exemplary embodiment includes the indefinite region associated with switching between stopping and driving of the developing roller 16 and the indefinite region associated with switching between separating and contacting of the developing roller 16. If it is detected that the developing roller 16 is actually driven, the D-motor 104 is stoppable before the developing roller 16 is brought into contact with the photosensitive member 13.

In the image forming apparatus 100 according to present exemplary embodiment, the current detection unit detects a change in the current flowing through the A-motor 101, thus making it possible to detect that driving of the developing roller 16 is actually started. The controller 31 of the image forming apparatus 100 stops the D-motor 104 before the developing roller 16 is brought into contact with the photosensitive member 13 based on the detection of a change in the current flowing through the A-motor 101 performed by the current detection unit. Since the A-motor 101 is in the driven state in this case, the developing roller 16 is rotated in a state where the developing roller 16 is separate from the photosensitive member 13.

Figure 6:
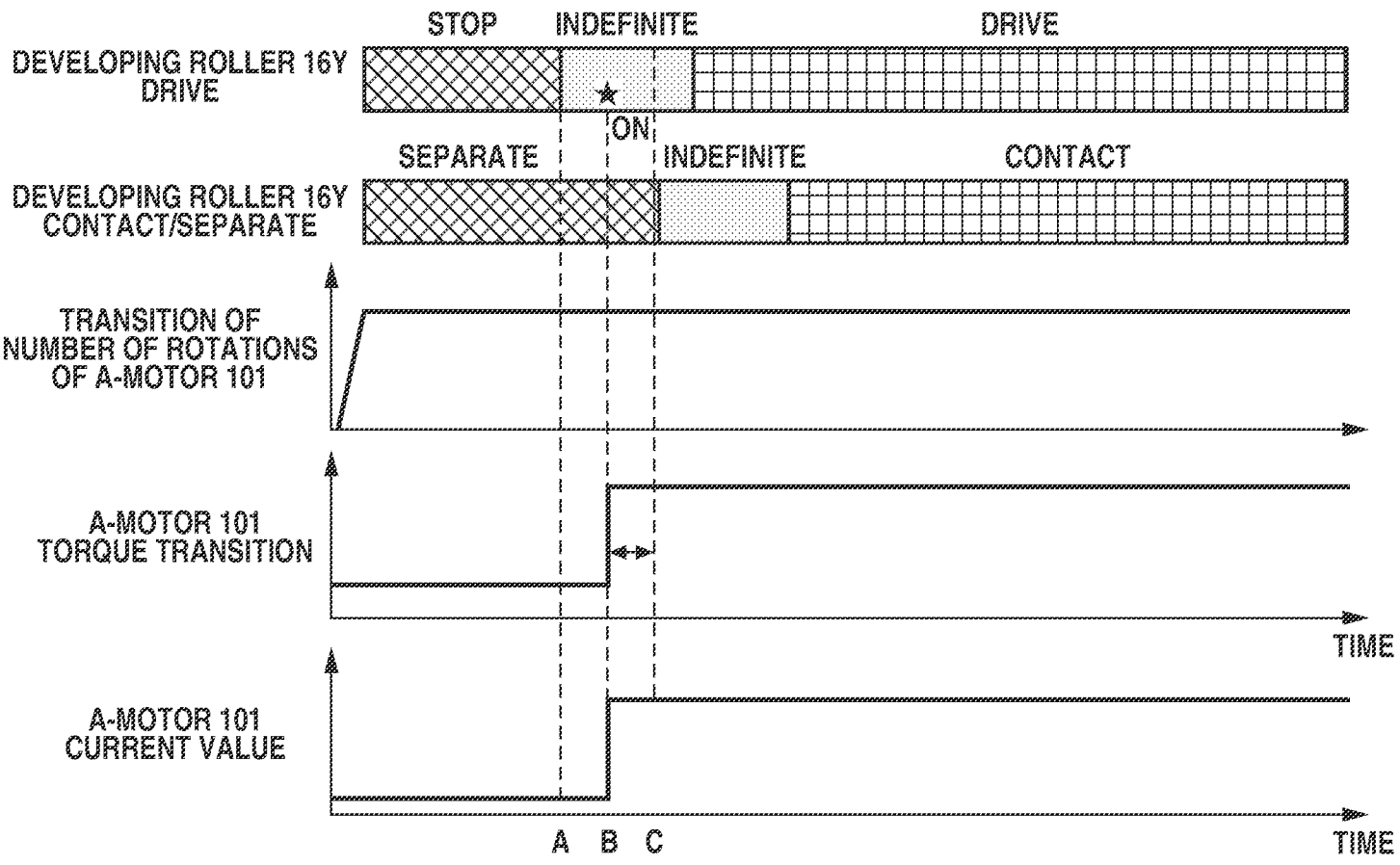
FIG. 6 is an explanatory diagram illustrating an operation of driving the developing roller and bringing the developing roller into contact with the photosensitive member according to a first exemplary embodiment.

FIG. 6 is an explanatory diagram illustrating an operation of driving the developing roller 16Y and bringing the developing roller 16Y into contact with the photosensitive member 13Y. The operation of each of the developing rollers 16M, 16C, and 16K is similar to the operation of the developing roller 16Y, and thus descriptions thereof are omitted. In FIG. 6, the horizontal axis represents time. In FIG. 6, the vertical axis represents the drive state of the developing roller 16Y, the contact or separated state of the developing roller 16Y, the transition of the number of rotations of the A-motor 101, torque transition of the A-motor 101, and current value transition of the A-motor 101.

Initially, the A-motor 101 and the D-motor 104 are activated and the rotation of the respective motors are started. When the number of steps of the D-motor 104 reaches the number of steps corresponding to a timing A in FIG. 6, the indefinite region associated with driving of the developing roller 16Y starts.

A timing when the mechanical clutch 105Y is switched from the non-transmission state to the transmission state is referred to as a timing B. When the mechanical clutch 105 is brought into the transmission state, the torque of the A-motor 101 increases. The speed of the A-motor 101 is controlled by a predetermined number of rotations. Thus, the current value of the A-motor 101 increases as the torque of the A-motor 101 increases. An increase in the current value of the A-motor 101 until the timing A and an increase in the current value at the timing B are detected by the current detection unit.

The CPU 32 of the controller 31 causes the current detection unit to detect the magnitude of the current flowing through the A-motor 101, thus detecting a timing when the driving of the developing roller 16Y is started.

As described above, the developing roller 16Y is brought into contact with the photosensitive member 13Y after the developing roller 16Y is driven. Accordingly, the D-motor 104 is stopped at a timing C before the developing roller 16Y is brought into contact with the photosensitive member 13Y after a predetermined period from a timing when driving of the developing roller 16Y is started. In response to the D-motor 104 being stopped, the developing movement mechanism 106Y is also stopped and the operation in which the developing roller 16Y approaches the photosensitive member 13Y is also stopped. This enables the state where the developing roller 16Y is driven and is separate from the photosensitive member 13 to be maintained.

In other words, in a case where the mechanical clutch 105 transitions from the non-transmission state to the transmission state, and the current detection unit has detected a change in the magnitude of the current flowing through the A-motor 101, the controller 31 performs an operation to stop the D-motor 104 before the developing roller 16Y is brought into contact with the photosensitive member 13Y. At this time, the A-motor 101 is continuously driven and the developing movement mechanism 106 is stopped, while the developing roller 16Y is continuously rotated. In the present exemplary embodiment, the operation in which the controller 31 stops the D-motor 104 based on the magnitude of the current that flows to the A-motor 101 and is detected by the current detection unit as described above is referred to as a stop operation (stop control, stop sequence). The controller 31 continuously performs the stop operation for a predetermined period, and then drives the D-motor 104 again to drive the developing movement mechanism 106 so that the developing roller 16Y is brought into contact with the photosensitive member 13Y. Thus, the developing roller 16Y is brought into contact with the photosensitive member 13Y in a state where the developing roller 16Y is coated with toner.

The controller 31 can also execute the stop operation on the developing rollers 16M, 16C, and 16K in a manner similar to the stop operation on the developing roller 16Y. Thus, the developing rollers 16M, 16C, and 16K can be driven in a state where the developing rollers 16M, 16C, and 16K are separate from the photosensitive members 13Y, 13M, and 13K, respectively.

<Seal Removal Sequence>

When the cartridge 12 according to the present exemplary embodiment is new, the opening 23*d* is covered with the seal member 24*a* so that toner is prevented from being supplied to the developing roller 16. When the cartridge 12 is new, the controller 31 performs the seal removal sequence in a state where the stop operation is performed.

Figure 7:
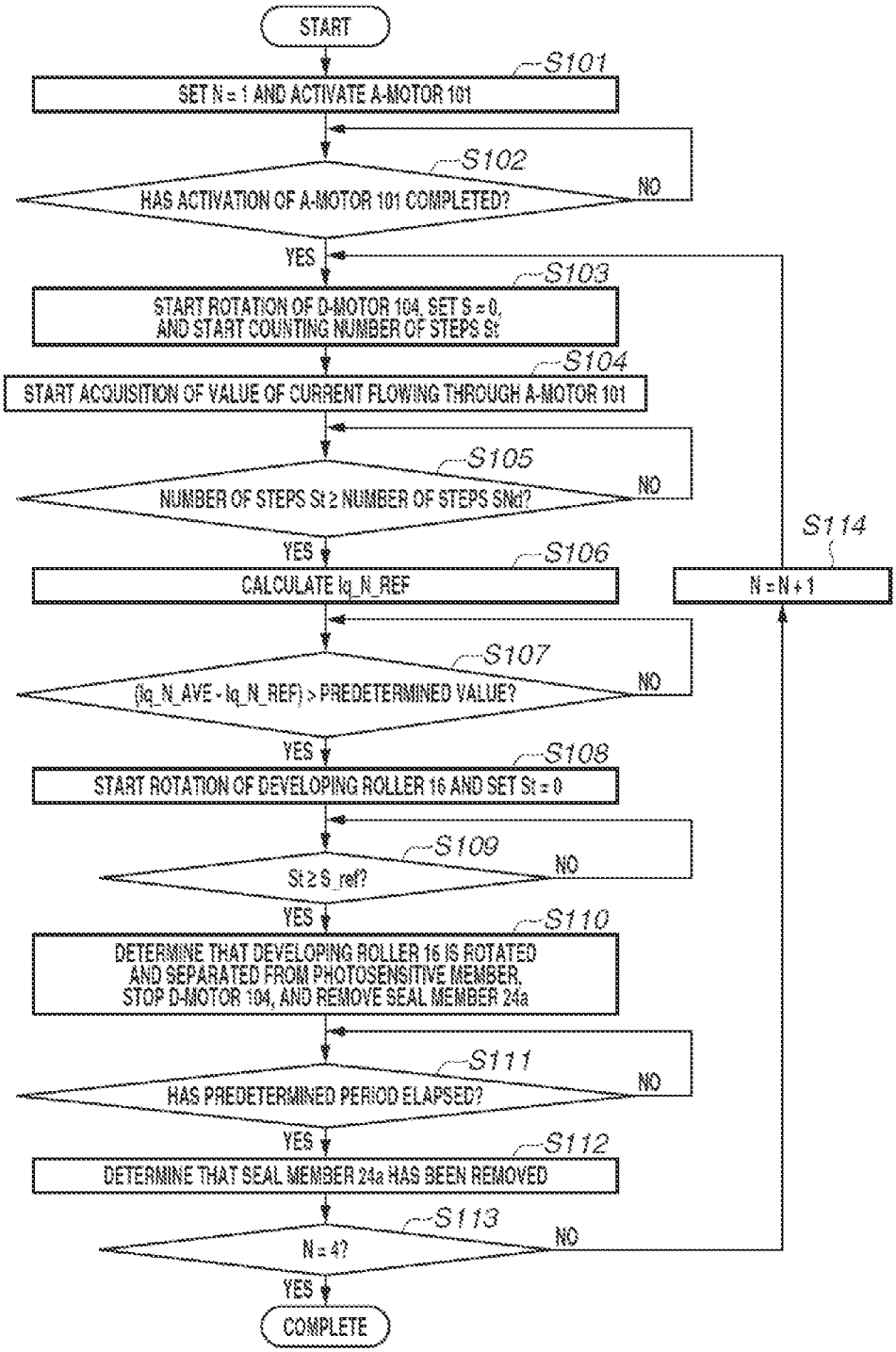
FIG. 7 is a flowchart illustrating a seal removal sequence according to the first exemplary embodiment.

The seal removal sequence according to the first exemplary embodiment will be described with reference to FIG. 7. FIG. 7 is a flowchart illustrating the seal removal sequence according to the present exemplary embodiment.

In response to the seal removal sequence being started, in step S101, the CPU 32 sets a counter N=1 as an initial setting and activates the A-motor 101. In step S102, the CPU 32 determines whether the activation of the A-motor 101 is completed. If the activation of the A-motor 101 is completed (YES in step S102), the processing proceeds to step S103.

Here, the counter N is associated with the respective stations Y, M, C, and K. When the counter N indicates "1", the seal removal sequence for the cartridge 12Y is performed. When the counter N indicates "2", the seal removal sequence for the cartridge 12M is performed. When the counter N indicates "3", the seal removal sequence for the cartridge 12C is performed. When the counter N indicates "4", the seal removal sequence for the cartridge 12K is performed.

In step S103, the CPU 32 starts rotation of the D-motor 104, sets the number of steps St of the D-motor 104 to "0" (St=0), and then starts counting of the number of steps St. In step S104, the current detection unit starts detection of the current flowing through the A-motor 101.

The current value calculated by the current calculation unit 128 is transmitted to the controller 31.

In step S105, the CPU 32 determines whether the number of steps St of the D-motor 104 is greater than or equal to the number of steps SNd. The number of steps SNd corresponds to a starting point of the indefinite region associated with driving of the developing roller 16 in the cartridge 12 on which the seal removal sequence is performed (see FIG. 5).

In step S106, the CPU 32 calculates a current average value Iq_N_REF. The current average value Iq_N_REF is an average of values of current flowing through the A-motor 101 in an interval from St=0 to SNd.

In step S107, the CPU 32 calculates a moving average Iq_N_AVE of the current values flowing through the A-motor 101 for last 10 microseconds (ms). Further, the CPU 32 determines whether the value obtained by subtracting Iq_N_REF from the moving average Iq_N_AVE is greater than a predetermined value (predetermined current value). When the driving force of the A-motor 101 is transmitted to the developing roller 16, the current flowing through the A-motor 101 increases. As a result, when the driving force of the A-motor 101 is transmitted to the developing roller 16, the value obtained by subtracting Iq_N_REF from the moving average Iq_N_AVE is greater than the predetermined value.

If the value obtained by subtracting Iq_N_REF from the moving average Iq_N_AVE is greater than the predetermined value (YES in step S107), the processing proceeds to step S108. In step S108, the CPU 32 determines that the rotation of the developing roller 16 is started. The CPU 32 resets the number of steps St of the D-motor 104 to "0".

Immediately after the value obtained by subtracting Iq_N_ REF from the moving average Iq_N_AVE has exceeded the predetermined value, the mechanical clutch 105 may incompletely transition to the transmission state. Thus, the CPU 32 stops the D-motor 104 after a lapse of a predetermined period from a time when the mechanical clutch 105 transitions from the non-transmission state to the transmission state and the magnitude of the current detected by the current detection unit has changed.

According to the present exemplary embodiment, in step S109, the CPU 32 determines whether the number of steps St of the D-motor 104 is greater than or equal to a predetermined number of steps S_ref. If the number of steps St is greater than or equal to the predetermined number of steps S_ref (YES in step S109), the processing proceeds to step S110.

In step S110, the CPU 32 determines that the developing roller 16 is being rotated and is separate from the photosensitive member 13, stops the D-motor 104, and stops the developing movement mechanism 106. By contrast, the A-motor 101 is continuously driven. Thus, the seal member 24*a* is removed by the unsealing member 24*b*. In other words, during the stop operation performed by the CPU 32, the unsealing member 24*b* moves the seal member 24*a* from the position at which the opening 23*d* is covered to expose the opening 23*d*.

In step S111, the CPU 32 determines whether a predetermined period has elapsed. If the predetermined period has elapsed (YES in step S111), the processing proceeds to step S112. In step S112, the CPU 32 determines that the seal member 24*a* has been removed. At this time, the CPU 32 may write information indicating that the cartridge 12 is not new (seal member 24*a* has been removed) into the memory 12MU of the cartridge 12.

In step S113, the CPU 32 determines whether the counter N indicates "4". If the counter N does not indicate "4" (NO in step S113), the processing proceeds to step S114. In step S114, the CPU 32 adds "1" to the counter N. The processing then returns to step S103. In response to the D-motor 104 being driven in step S103, the developing movement mechanism 106 is driven.

In step S113, if the counter N indicates "4" (YES in step S113), the seal removal sequence on all the cartridges (12Y, 12M, 12C, 12K) is complete. After completion of the seal removal sequence, the CPU 32 drives the D-motor 104 to be returned to the home position.

The present exemplary embodiment described above illustrates a state where the cartridges (12Y, 12M, 12C, 12K) are new (state where the seal member 24*a* has not been removed from any of the cartridges (12Y, 12M, 12C, 12K)). However, in a state where some of the cartridges (12Y, 12M, 12C, 12K) are new, it is sufficient to execute the seal removal sequence only on the new cartridges. For example, the CPU 32 may start the seal removal sequence in a case where some of the cartridges (12Y, 12M, 12C, 12K) are new, and may determine whether the cartridge 12 corresponding to the counter N is new before the processing returns to step S103. In such a case, if the cartridge 12 corresponding to the counter N is not new, the processing proceeds to step S113. If the counter N does not indicate "4", the processing proceeds to step S114 and the CPU 32 determines again whether the cartridge 12 corresponding to the counter N is new before the processing returns to step S103.

As described above, the CPU 32 performs the seal removal sequence along with the stop operation to stop the D-motor 104 to allow the developing roller 16 to rotate after the developing roller 16 starts rotation and before the developing roller 16 is brought into contact with the photosensitive member 13. It is desirable to execute the stop operation and the seal removal sequence when the cartridge 12 is new. By contrast, it is desirable that the CPU 32 does not perform the stop operation or the seal removal sequence when the cartridge 12 is not new, for example, during a normal image forming operation. However, the CPU 32 may perform the stop operation, as needed, when the cartridge 12 is not new.

As described above, the magnitude of the current flowing through the A-motor 101 is detected, thus enabling the D-motor 104 to be stopped so that the developing roller 16 is rotated after the developing roller 16 starts rotation and before the developing roller 16 is brought into contact with the photosensitive member 13. This enables the developing roller 16 to be brought into contact with the photosensitive member 13 in a state where the developing roller 16 is fully coated with toner, while the first printing period is shortened and the wear of the developing roller 16 is prevented.

A second exemplary embodiment will now be described. While the first exemplary embodiment described above illustrates a case where the D-motor 104 is a stepping motor, the second exemplary embodiment illustrates a case where the D-motor 104 is a motor other than a stepping motor, that is, the D-motor 104 is a motor for which the number of steps is not manageable.

In the second exemplary embodiment, differences from the first exemplary embodiment are mainly described. The components and operations of the second exemplary embodiment that are identical to those of the first exemplary embodiment are denoted by the same reference numerals, and the descriptions thereof are basically omitted.

In the second exemplary embodiment, the stop operation for the D-motor 104 is performed using the position sensor of the D-motor 104. The operation of the developing roller 16Y will be described below. The operation of each of the developing rollers 16M, 16C, and 16K is also similar to the operation of the developing roller 16Y, and thus the description thereof is omitted.

Figure 8:
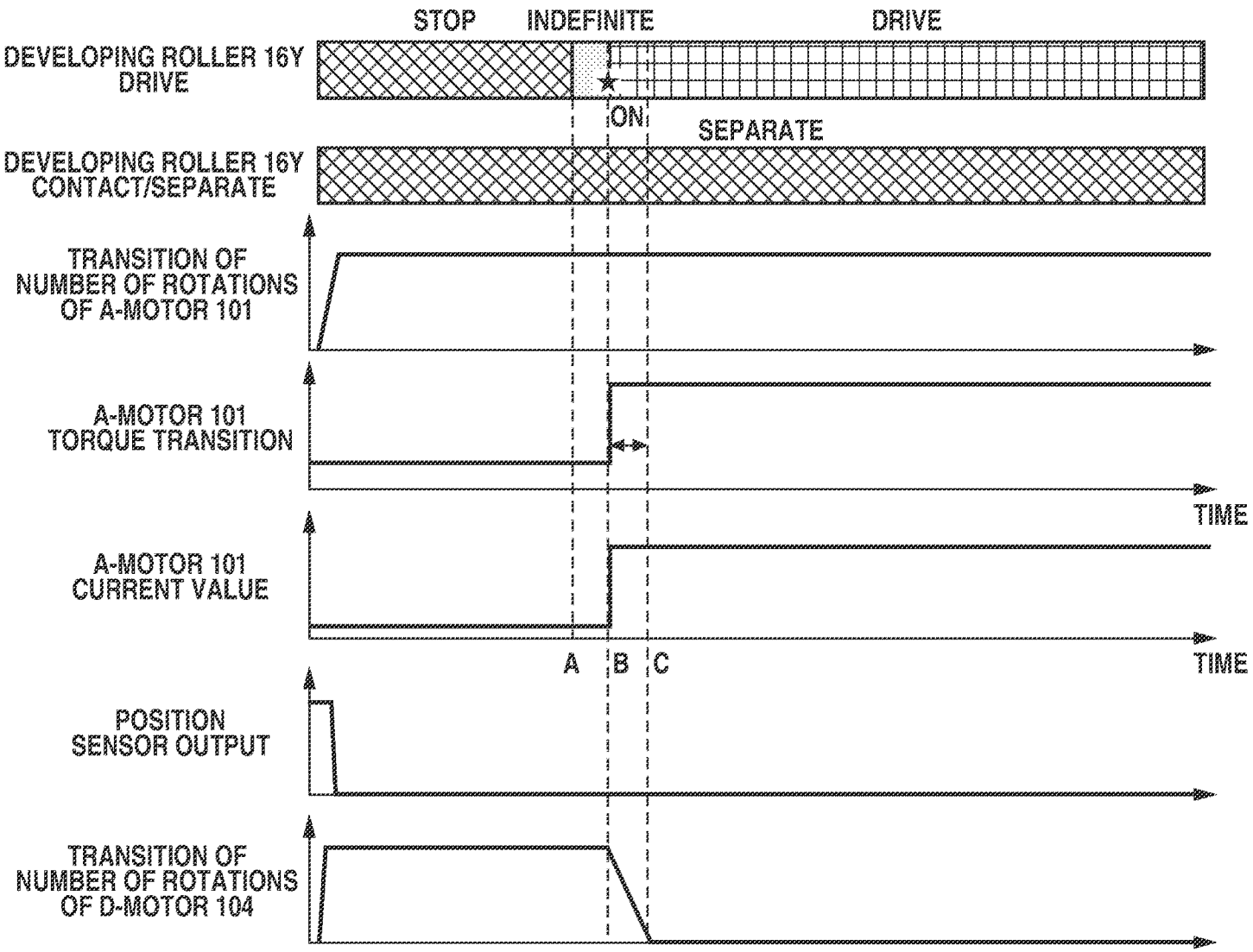
FIG. 8 is an explanatory diagram illustrating an operation of driving the developing roller and bringing the developing roller into contact with the photosensitive member according to a second exemplary embodiment.

FIG. 8 is an explanatory diagram illustrating an operation of driving the developing roller 16Y and bringing the developing roller 16Y into contact with the photosensitive member 13Y according to the present exemplary embodiment. In FIG. 8, the horizontal axis represents time. In FIG. 8, the vertical axis represents the drive state of the developing roller 16Y, the contact or separated state of the developing roller 16Y, the transition of the number of rotations of the A-motor 101, torque transition of the A-motor 101, current value transition of the A-motor 101, position sensor output, and the transition of the number of rotations of the D-motor 104.

Initially, the A-motor 101 is activated and the rotation of the D-motor 104 is started. The D-motor 104 is stopped at a position at which the output from the position sensor is at the high level. When the rotation of the D-motor 104 is started, the output from the position sensor is switched to the low level. When it is detected that the output from the position sensor is switched to the low level, the home position is detected. The D-motor 104 is rotated for a predetermined period after the home position is detected, the timing A is reached. The timing A matches the starting point of the indefinite region associated with driving of the developing roller 16Y.

When the mechanical clutch 105Y transitions from the non-transmission state to the transmission state, the current flowing through the A-motor 101 increases. The CPU 32 issues a stop instruction to the D-motor 104 based on an increase in the current flowing through the A-motor 101. Thus, the D-motor 104 is stopped at the timing C and the developing roller 16Y is driven in a state where the developing roller 16Y is separate from the photosensitive member 13Y.

<Seal Removal Sequence>

Figure 9:
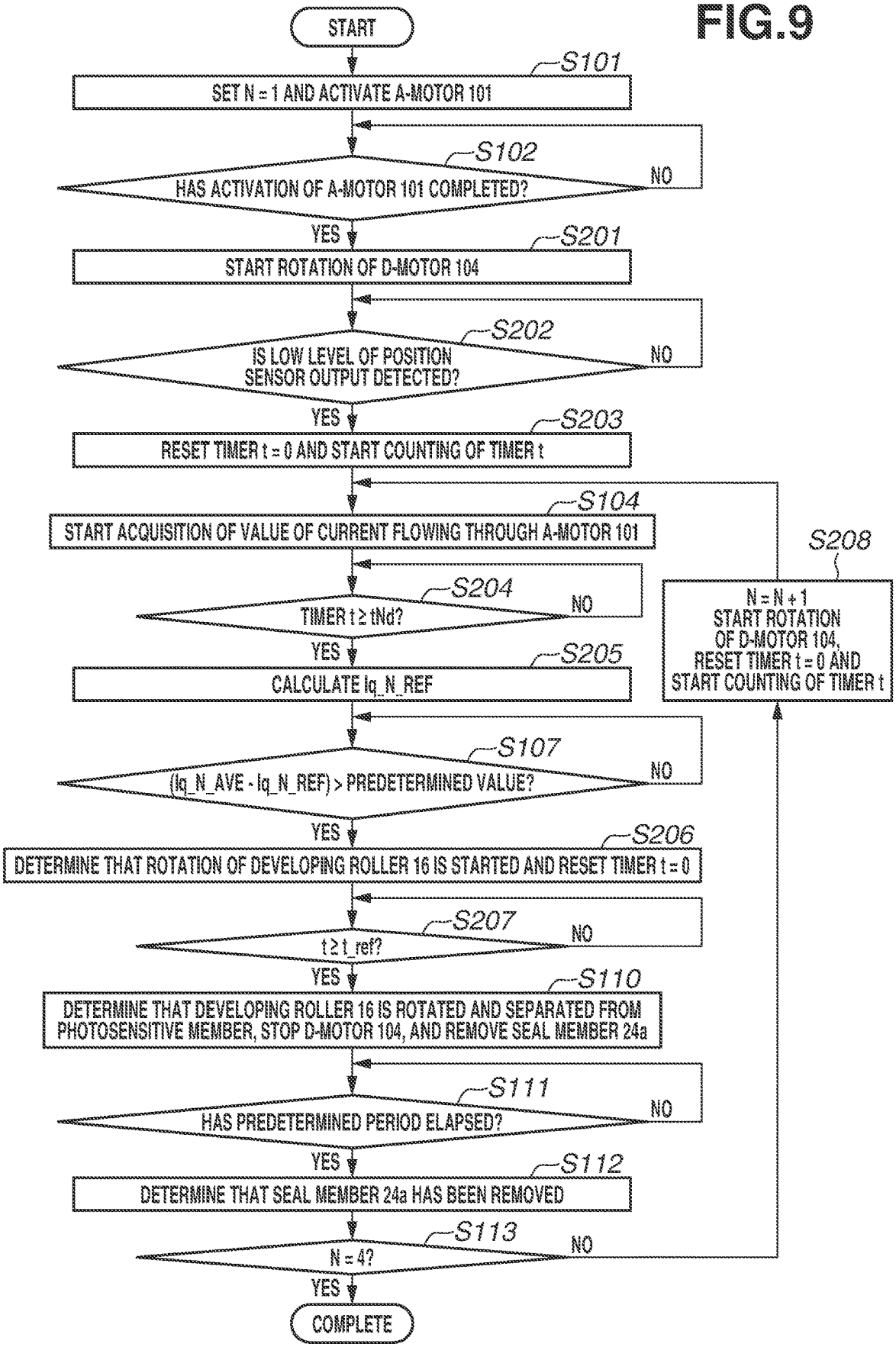
FIG. 9 is a flowchart illustrating the seal removal sequence according to the second exemplary embodiment.

The seal removal sequence according to the second exemplary embodiment will be described with reference to FIG. 9. FIG. 9 is a flowchart illustrating the seal removal sequence according to the present exemplary embodiment.

The seal removal sequence is started and the operations in steps S101 and S102 are performed, and then the processing proceeds to step S201. In step S201, the rotation of the D-motor 104 is started.

In step S202, the CPU 32 determines whether the low level of the position sensor output is detected. If the low level of the position sensor output is detected (YES in step S202), the processing proceeds to step S203. In step S203, the CPU 32 resets a timer t of the D-motor 104 and starts counting of the timer t.

In step S104, the current detection unit starts acquisition of the value of current flowing through the A-motor 101. In step S204, the CPU 32 determines whether the timer t has reached a timing tNd. The timing tNd corresponds to the starting point of the indefinite region associated with driving of the developing roller 16 in the cartridge 12 on which the seal removal sequence is performed (see FIGS. 5 and 8).

When the timer t of the D-motor 104 has reached the timing tNd (YES in step S204), the processing proceeds to step S205. In step S205, the CPU 32 calculates Iq_N_REF. The current average value Iq_N_REF is an average of values of current flowing through the A-motor 101 in an interval from t=0 to tNd.

As in the first exemplary embodiment, in step S107, the CPU 32 calculates the moving average Iq_N_AVE of the current values flowing through the A-motor 101 for last 10 ms. Further, the CPU 32 determines whether the value obtained by subtracting Iq_N_REF from the moving average Iq_N_AVE is greater than a predetermined value (predetermined current value).

If the value obtained by subtracting Iq_N_REF from the moving average Iq_N_AVE is greater than the predetermined value (YES in step S107), the processing proceeds to step S206. In step S206, the CPU 32 determines that the rotation of the developing roller 16 is started and resets the timer t.

Immediately after the value obtained by subtracting Iq_N_ REF from the moving average Iq_N_AVE exceeds the predetermined value, the mechanical clutches 105 (105Y, 105M, 105C, 105K) may incompletely transition to the transmission state. Accordingly, the CPU 32 stops the D-motor 104 after a lapse of a predetermined period from a time when the mechanical clutch 105 transitions from the non-transmission state to the transmission state and the magnitude of the current detected by the current detection unit has changed. According to the present exemplary embodiment, in step S207, the CPU 32 determines whether the value of the timer t of the D-motor 104 is greater than or equal to a predetermined timing t_ref. If the value of the timer t is greater than or equal to the predetermined timing t_ref (YES in step S207), the processing proceeds to step S110.

The operations of steps S111, S112, and S113 are similar to those in the first exemplary embodiment. In step S113, the CPU 32 determines whether the counter N indicates "4". If the counter N does not indicate "4", the processing proceeds to step S208. In step S208, the CPU 32 adds "1" to the counter N and starts rotation of the D-motor 104. After the timer t is reset, the processing returns to step S104.

In step S113, if the counter N indicates "4" (YES in step S113), the seal removal sequence is complete for all the cartridges (12Y, 12M, 12C, 12K). After completion of the seal removal sequence, the CPU 32 returns the D-motor 104 to the home position.

The present exemplary embodiment described above also illustrates a state where the cartridges (12Y, 12M, 12C, 12K) are new (state where the seal member 24*a* has not been removed from each of the cartridges (12Y, 12M, 12C, 12K)). However, in a state where some of the cartridges (12Y, 12M, 12C, 12K) are new, the seal removal sequence may be executed only on the new cartridges.

As described above, even in a case where the D-motor 104 is a motor that cannot manage the number of steps, the D-motor 104 can be stopped and the developing roller 16 can be rotated after the rotation of the developing roller 16 is started and before the developing roller 16 is brought into contact with the photosensitive member 13. This enables the developing roller 16 to be brought into contact with the photosensitive member 13 in a state where the developing roller 16 is fully coated with toner, while the first printing period is shortened and the wear of the developing roller 16 is prevented.

(Modified Examples)

In the present exemplary embodiment, the A-motor 101 is a brushless motor, but instead may be a brush motor.

The present exemplary embodiment described above illustrates an example where the CPU 32 determines whether the rotation of the developing roller 16 is started based on whether the value obtained by subtracting Iq_N_REF from the moving average Iq_N_AVE exceeds the predetermined value. However, the present disclosure is not limited to this example. For example, the CPU 32 may determine whether the rotation of the developing roller 16 is started based on whether the value of current flowing through the A-motor 101 exceeds a predetermined threshold.

According to an aspect of the present invention, it is possible to provide an image forming apparatus configured to bring a developing roller into contact with a photosensitive member after the developing roller is fully rotated in a configuration in which the developing roller is movable between a position at which the developing roller is brought into contact with the photosensitive member and a position at which the developing roller is separate from the photosensitive member.

Embodiments of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described Embodiments and/or that includes one or more circuits (e.g., application specific integrated circuit (ASIC)) for performing the functions of one or more of the above-described Embodiments, and by a method performed by the computer of the system or apparatus by, for example, reading out and executing the computer executable instructions from the storage medium to perform the functions of one or more of the above-described Embodiments and/or controlling the one or more circuits to perform the functions of one or more of the above-described Embodiments. The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc™ (BD)), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-182334, filed Nov. 9, 2021, which is hereby incorporated by reference herein in its entirety.

What is claimed is:

1. An image forming apparatus comprising:

a photosensitive member;

a developing roller;

a first motor configured to drive the developing roller;

a drive-train configured to transmit a driving force of the first motor to the developing roller and including a drive switching unit, wherein the drive switching unit is configured to switch between a transmission state where the driving force is transmitted to the developing roller and a non-transmission state where the driving force is not transmitted to the developing roller;

a development switching unit configured to switch between a contact state where the developing roller is brought into contact with the photosensitive member and a separated state where the developing roller is separate from the photosensitive member, and configured to operate in conjunction with an operation of the drive switching unit;

a second motor configured to drive the development switching unit and the drive switching unit;

a control unit configured to control the first motor and the second motor; and a current detection unit configured to detect a current flowing through the first motor, wherein, in a case where the drive switching unit transitions from the non-transmission state to the transmission state and a magnitude of the current detected by the current detection unit has changed, the control unit is configured to execute a stop operation to stop the second motor before the developing roller is brought into contact with the photosensitive member while driving the first motor.

2. The image forming apparatus according to claim 1, wherein the control unit drives the second motor to bring the developing roller into contact with the photosensitive member after the stop operation is continuously performed for a predetermined period.

3. The image forming apparatus according to claim 1, further comprising a developing unit that includes:

(i) a storage portion storing developer and having an opening through which the stored developer is supplied to the developing roller, (ii) a seal member covering the opening, (iii) an unsealing member configured to be driven by the driving force of the first motor and to move the seal member, and (iv) the developing roller, wherein the unsealing member moves the seal member from a position at which the opening is covered to expose the opening during the stop operation performed by the control unit.

4. The image forming apparatus according to claim 3, wherein the developing unit is detachable from an apparatus body.

5. The image forming apparatus according to claim 1, wherein the second motor is a stepping motor, and wherein the control unit is configured to stop the second motor after a lapse of a predetermined period from a time when the drive switching unit transitions from the non-transmission state to the transmission state and the magnitude of the current detected by the current detection unit has changed.

6. The image forming apparatus according to claim 1, wherein the first motor is a brushless motor.

7. The image forming apparatus according to claim 1, wherein the first motor is controlled by vector control.

8. The image forming apparatus according to claim 1, further comprising a cleaning member configured to be brought into contact with the photosensitive member.

* * * * *